US007343734B2

(12) United States Patent
Aliakbarzadeh et al.

(10) Patent No.: US 7,343,734 B2
(45) Date of Patent: Mar. 18, 2008

(54) METHOD FOR ADJUSTING A DEFINED OXYGEN CONCENTRATION BY MEANS OF BINARY LAMBDA REGULATION IN ORDER TO DIAGNOSE AN EXHAUST GAS CATALYST

(75) Inventors: Reza Aliakbarzadeh, Regensburg (DE); Gerd Rösel, Regensberg (DE); Milos Tichy, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 436 days.

(21) Appl. No.: 10/510,648

(22) PCT Filed: Jan. 15, 2004

(86) PCT No.: PCT/EP2004/000272

§ 371 (c)(1),
(2), (4) Date: Jun. 3, 2005

(87) PCT Pub. No.: WO2004/074664

PCT Pub. Date: Sep. 2, 2004

(65) Prior Publication Data

US 2005/0252196 A1 Nov. 17, 2005

(30) Foreign Application Priority Data

Feb. 19, 2003 (DE) ..... 103 07 010

(51) Int. Cl.
*F01N 3/00* (2006.01)

(52) U.S. Cl. ..... 60/277; 60/274; 60/276; 60/285

(58) Field of Classification Search ..... 60/274, 60/276, 277, 285, 299
See application file for complete search history.

(56) References Cited

U.S. PATENT DOCUMENTS

| | | | | |
|---|---|---|---|---|
| 5,325,664 | A | 7/1994 | Seki et al. | |
| 5,602,737 | A * | 2/1997 | Sindano et al. | 701/108 |
| 6,092,369 | A * | 7/2000 | Hosogai et al. | 60/277 |
| 6,226,982 | B1 * | 5/2001 | Poggio et al. | 60/276 |
| 6,517,784 | B1 * | 2/2003 | Iizuka et al. | 422/177 |

(Continued)

FOREIGN PATENT DOCUMENTS

| | | |
|---|---|---|
| DE | 23 28 459 | 1/1975 |

(Continued)

*Primary Examiner*—Thomas Denion
*Assistant Examiner*—Diem Tran
(74) *Attorney, Agent, or Firm*—Laurence A. Greenberg; Werner H. Stemer; Ralph E. Locher

(57) ABSTRACT

The invention relates to a method for diagnosing a regulated exhaust gas catalyst, according to which regulating the catalyst results in control cycles, catalyst diagnosis being performed at a predetermined oxygen concentration per control cycle. A fuel mixture can be adjusted fat or lean according to a specific lambda control factor. A fat or lean exhaust gas is detected, the lambda control factor being incrementally decreased when a lean exhaust gas is detected. The lambda control factor is modified by a P step following a detected change from a fat to lean exhaust gas or from a lean to a fat exhaust gas, the lambda control factor being set to a minimum value during a first loading period following a detected change from a fat exhaust gas to a lean exhaust gas while being set to a maximum value during a second loading period following a detected change from a lean exhaust gas to a fat exhaust gas. The first and the second loading period are adjusted such that the oxygen concentration reaches the predetermined oxygen concentration in each control cycle.

5 Claims, 1 Drawing Sheet

U.S. PATENT DOCUMENTS

| | | | | |
|---|---|---|---|---|
| 6,694,243 | B2 * | 2/2004 | Shi et al. | 701/114 |
| 7,055,312 | B2 * | 6/2006 | Osawa et al. | 60/285 |
| 2002/0178714 | A1 * | 12/2002 | Shi et al. | 60/285 |

FOREIGN PATENT DOCUMENTS

| | | | |
|---|---|---|---|
| DE | 196 06 652 | A1 | 8/1997 |
| DE | 196 33 481 | A1 | 5/1998 |
| DE | 198 44 994 | A1 | 4/2000 |
| DE | 43 31 153 | C2 | 2/2001 |
| DE | 196 20 417 | C2 | 2/2001 |
| DE | 100 17 931 | A1 | 12/2001 |
| EP | 1 227 231 | A2 | 7/2002 |
| WO | WO 93/09335 | | 5/1993 |

* cited by examiner

METHOD FOR ADJUSTING A DEFINED OXYGEN CONCENTRATION BY MEANS OF BINARY LAMBDA REGULATION IN ORDER TO DIAGNOSE AN EXHAUST GAS CATALYST

BACKGROUND OF THE INVENTION

Field of the Invention

Exhaust gas catalysts for motor vehicles, hereafter referred to simply as catalysts, are subject to ageing phenomena. Legislation requires catalyst function to be checked in every drive cycle. Reliable catalyst function is determined using the oxygen storage capacity of the catalyst. The catalyst is diagnosed over a plurality of lambda regulation periods, which overlap with catalyst diagnosis periods. To achieve the smallest possible spread in individual diagnosis cycles, a defined oxygen concentration is required in the catalyst that can be repeated in each of the control cycles required for regulation.

In the case of linear lambda regulation this defined oxygen concentration can be achieved with a defined forced activation. Cyclical deviations in respect of the stoichiometric lambda target value are thereby adjusted, whereby half-periods with lean and rich exhaust gas alternate. In the half-period with lean exhaust gas the oxygen storage unit of the catalyst is filled, with excess oxygen being stored, while in the half-period with rich exhaust gas the oxygen storage unit of the catalyst is evacuated, with oxygen being used for the oxidation of exhaust gas components. The instantaneous oxygen input is positive when excess oxygen is stored in the catalyst; it is negative when the oxygen required in the rich exhaust gas for oxidation reactions is extracted from the catalyst (if it was stored beforehand).

In the case of binary lambda regulation, regulation is based on feedback from the lambda probe that the exhaust gases correspond to a rich or lean mixture. If the lambda probe signal indicates too rich a fuel mixture, the quantity of fuel is continuously depleted, whereby the oxygen used for oxidation reactions is extracted from the catalyst. Depletion takes place until the lambda probe signal changes and indicates too lean a fuel mixture, whereby the excess oxygen is stored in the catalyst. There is then a short dwell time, which can compensate for slight lambda displacements, i.e. different reaction times on the part of the lambda probe. A P step (proportional step) of the lambda control factor then takes place in the enrichment direction and the fuel mixture is then continuously enriched, until the binary lambda probe indicates too rich a mixture. This is followed by a corresponding dwell time and a P step of the lambda control factor in the depletion direction. This control cycle is repeated.

The length of the control cycle and the amplitude are essentially determined by the system transport delay and the reaction time of the lambda probe. The system transport delay is highly dependent on the operating point of the engine. This subjects the oxygen concentration of the catalyst to changes, which make it difficult to determine the efficiency of the catalyst. Also newer catalysts have a bigger oxygen storage capacity to comply with future emission limits (e.g. ULEV, LEV II), so a greater oxygen concentration is required to diagnose catalyst efficiency than is automatically adjusted in a control cycle.

To date standard PI lambda regulators were known with extended dwell times, to achieve greater oxygen concentration. The oxygen concentration is subject to a high level of spread from control cycle to control cycle and is a significant function of the operating point. As a result the individual cycles of the catalyst efficiency diagnosis are also subject to a high level of spread, so there is not an adequate distinction between catalysts of different ages.

BRIEF SUMMARY OF THE INVENTION

The object of the present invention is therefore to provide a reproducible catalyst efficiency diagnosis that is less susceptible to malfunction.

According to a first aspect of the present invention a method is provided for adjusting a defined oxygen concentration to diagnose a catalyst. Catalyst regulation results in control cycles. The catalyst is diagnosed at a predetermined oxygen concentration for each control cycle. A fuel mixture can be adjusted to rich or lean according to a lambda control factor. Rich or lean exhaust gas is detected for the fuel mixture, whereby if a lean exhaust gas is detected for the fuel mixture, the lambda control factor is increased incrementally and if a rich exhaust gas is detected for the fuel mixture, the lambda control factor is decreased incrementally. After a change has been detected from a rich exhaust gas to a lean exhaust gas or from a lean exhaust gas to a rich exhaust gas for the fuel mixture, the lambda control factor is changed by a P step of the lambda control factor.

Also after a change has been detected from a rich exhaust gas to a lean exhaust gas for the fuel mixture, the lambda control factor is set to a minimum control factor value during a first loading period and after a change has been detected from a lean exhaust gas to a rich exhaust gas for the fuel mixture, the lambda control factor is set to a maximum control factor value for a second loading period. The minimum control factor is determined by a local minimizing of the control factor value of the current control cycle and the maximum control factor by a local maximum of the control factor value of the current control cycle. The first and second loading periods are adjusted so that the oxygen concentration achieves the defined oxygen concentration in each control cycle, i.e. the predetermined oxygen input or oxygen output depending on the half-period of the control cycle.

The lambda control factor can be used to adjust the mixture to rich or lean. If a rich exhaust gas is detected with the lambda probe, the lambda control factor is continuously decreased and the mixture thereby depleted, until the lambda probe detects a lean exhaust gas. A dwell time then takes place, during which the lambda control factor is maintained, to compensate for the difference in probe switching times or to achieve a slight mixture displacement, as with a standard lambda regulator. There is then an additional P step $\Delta P$ also in the depletion direction of the lambda control factor to the minimum control factor value, which results from the maximum difference in respect of the lambda control factor mean value, so that the value of the predetermined oxygen concentration is achieved more quickly. A P step then takes place to the sum of the incremental decreases and the additional P step $\Delta P$ in the enrichment direction. As a lean exhaust gas is detected at the lambda probe, the lambda control factor is now increased continuously and the fuel mixture thereby enriched, until the lambda probe detects a rich exhaust gas. A dwell time then takes place to compensate for the different in probe switching times or to achieve a mixture displacement. An additional P step then takes place in the enrichment direction, which is limited by the maximum difference in respect of the lambda control factor mean value, so that the oxygen output—corresponding to the oxygen input in the lean half-period—is achieved more quickly. For catalyst diagnosis it is important to be able to adjust the amplitude of the lambda fluctuation by means of the additional P step or by limiting the maximum amplitude as a function of the operating point, so that the oxygen storage characteristics in the catalyst can be taken into account during catalyst diagnosis.

The inventive method has the result that in an enrichment half-period—oxygen output from the catalyst—i.e. the mixture is enriched, or a depletion half-period—oxygen input in the catalyst, i.e. the fuel mixture is depleted, after a change has been detected between rich and lean exhaust gas, the fuel mixture is again changed by a ΔP step or set to a maximum difference in respect of the lambda control factor mean value, to achieve the as yet not achieved predefined oxygen concentration as quickly as possible with determined lambda amplitude. Adjustment of the lambda control factor to the maximum control factor value, which is a function of the predetermined oxygen concentration, means that the predetermined defined oxygen concentration is achieved quickly, once a change has been detected between rich and lean exhaust gas.

After the predetermined oxygen concentration has been achieved, the lambda control factor is reset quickly by the sum of the P steps (standard P step+ΔP step) implemented during the course of the respective half-period. As before the lambda control factor is now increased or decreased step by step and the fuel mixture thereby depleted or enriched.

The predetermined defined oxygen concentration is preferably determined by the maximum oxygen storage capacity of an ageing catalyst. In this way the catalyst efficiency diagnosis can also be carried out even with an ageing catalyst at a catalyst oxygen concentration that can be repeated in every control cycle and is a function of the operating point.

The minimum or maximum control factor value is preferably determined by the difference between the lambda control factor the lambda control factor mean value and is predetermined by the oxygen storage speed of the catalyst. The oxygen storage speed of the catalyst is a function of the throughflow of the exhaust gases through the catalyst and the catalyst temperature and essentially describes the maximum quantity of oxygen that can diffuse into the catalyst and be bound per unit of time. The control factor value is thus adjusted to a minimum or maximum value, at which the oxygen diffusion speed is not yet exceeded and which results in measurable oxygen behind the catalyst, even though the storage capacity has not yet been exceeded.

According to a further aspect of the present invention a regulator is provided for diagnosing a regulated catalyst. The regulator adjusts a defined maximum oxygen concentration for each control cycle to carry out a catalyst diagnosis. The regulator controls the composition of a fuel mixture, whereby regulation results in control cycles. The regulator can be connected for this purpose to an injection system, to adjust the fuel mixture to rich or lean according to a lambda control factor. A sensor is used to detect lean or rich exhaust gas. The regulator increases the lambda control factor incrementally in the event of lean exhaust gas and decreases the lambda control factor incrementally in the event of rich exhaust gas. The regulator sets the lambda control factor to a minimum control factor after a change has been detected from a rich exhaust gas to a lean exhaust gas for the fuel mixture during a first loading period, whereby after the end of the first loading period the control factor value is set to a mean value of the lambda control factor. The regulator also sets the lambda control factor to a maximum control factor value during a second loading period, after a change has been detected from a lean exhaust gas to a rich exhaust gas for the fuel mixture. After the end of the second loading period the lambda control factor is changed to a mean value of the lambda control factor by the regulator. The first and second loading times are determined such that the oxygen concentration, i.e. the oxygen input or output, achieves the predetermined maximum positive or negative oxygen concentration in each control cycle.

The inventive regulator has the advantage that it regulates the fuel mixture such that the oxygen concentration is the same in every control cycle, so that a reproducible oxygen concentration over a plurality of control cycles allows reproducible catalyst diagnosis with less susceptibility to malfunction.

The regulator can preferably be operated in a diagnosis mode to diagnose a catalyst and can be operated in a second mode, in which the regulator regulates in the same way as a hitherto known standard PI lambda regulator. In this way catalyst diagnosis only represents an operating mode of an already provided regulator so that the structure of the overall system comprising a regulator, injection system, engine and catalyst does not essentially have to be changed.

A preferred embodiment of the invention is described in more detail below with reference to the accompanying drawings, in which:

DESCRIPTION OF THE INVENTION

Figure 1:
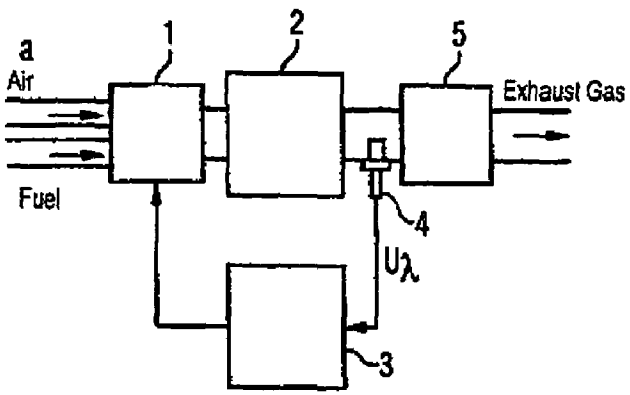
FIG. 1 shows an engine system with a regulator according to a preferred embodiment of the invention.

FIG. 1 shows a functional diagram of an engine system. The engine system has a mixer 1, which supplies a fuel mixture comprising air and engine fuel to an internal combustion engine 2. The internal combustion engine 2 combusts the fuel mixture and emits exhaust gases, which are fed to a three-way catalyst 5. The exhaust gas emitted by the internal combustion engine 2 is directed via a lambda probe 4, which determines from the composition of the exhaust gas whether the mixture is richer or leaner than the stoichiometric fuel mixture.

The lambda probe 4 is connected to a regulator 3, so that a measurement value measured by the lambda probe 4 is available as an input value for the regulator. The regulator 3 is a binary regulator, which obtains as an input variable from the lambda probe just the information whether the exhaust gas corresponds to a too rich or too lean fuel mixture. The regulator 3 uses this to generate a correcting variable, which is transmitted to the mixer 1. The correcting variable is the lambda control factor, which indicates the factor by which the basic fuel mixture ratio predetermined by an injection system (not shown) should be changed.

A catalyst efficiency diagnosis can be carried out by checking the performance of the catalyst 5. For such an efficiency diagnosis it is important for there to be as little spread as possible between individual diagnosis cycles. This can be achieved by loading the catalyst with the same quantity of oxygen in each control cycle. While it is possible to achieve the same oxygen concentration in the control cycles with a defined forced activation in the case of linear lambda regulation, this is not possible in the case of binary lambda regulation. Binary lambda regulation uses the lambda control factor to regulate the mixture composition with reference to a binary signal that is a function of the lambda probe or the probe voltage $U_\lambda$, which indicates whether the fuel mixture is too rich or too lean, whereby the control deviation is not known.

Figure 2:
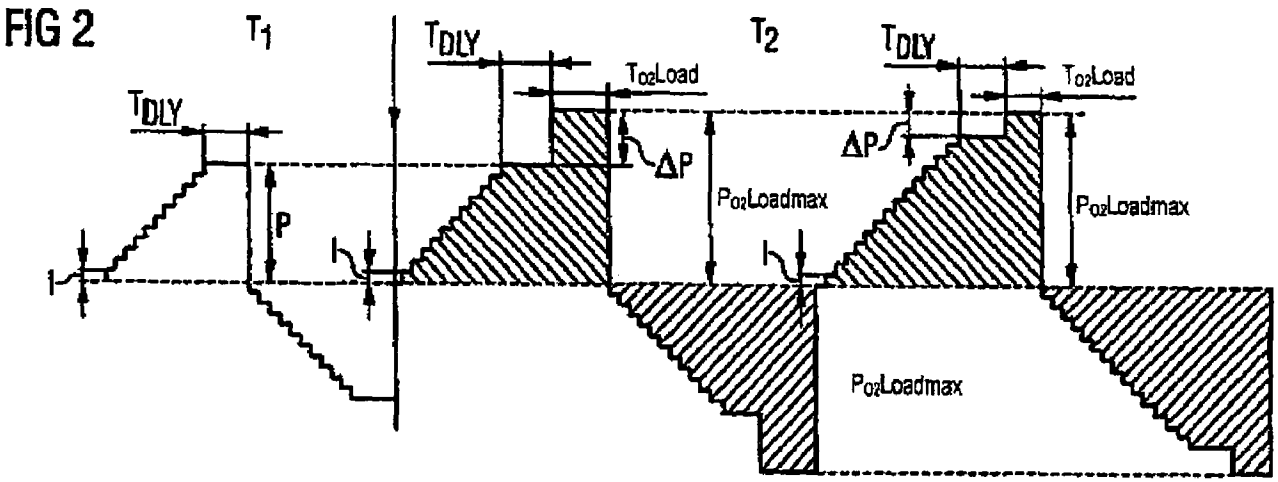
FIG. 2 shows the characteristics of the lambda control factor over a plurality of control cycles.

As the length of the control cycles is a function of the operating point, there is not a constant oxygen concentration over the control cycles during normal operation. After activation of the catalyst efficiency diagnosis however, the device switches to lambda regulation based on oxygen concentration. FIG. 2 shows the characteristics over time of the lambda control factor.

In a first time segment T1 the regulator 3 is in normal operation, i.e. lambda control is done by cyclical fluctuation of the lambda control factor about a mean value corresponding to a lambda value of around 1, i.e. a stoichiometric mean value. The control cycles are referred to as lean half-periods when the lambda control factor is smaller than its mean value and as rich half-periods when the lambda control factor is greater than its mean value.

During the lean half-period there is more oxygen in the fuel mixture than is predetermined by the stoichiometric mean, i.e. than is required for optimum operation of the catalyst. This results in a positive oxygen concentration during the lean half-period. During the rich half-period there is less oxygen in the fuel mixture than is predetermined by the stoichiometric mean, i.e. less than is required for optimum operation, so oxygen is emitted from the catalyst to the exhaust gas for oxidation reactions. This is referred to as a negative oxygen concentration (oxygen output).

Lambda regulation is achieved by a gradual increase in the lambda control factor in the phase, in which the lambda probe reports lean exhaust gas, as a result of which the fuel mixture is increasingly enriched. This is represented by the step by step increase in the lambda control factor over time in the first time segment T1. As soon as the lambda probe 4 detects that the fuel mixture is too rich, the step by step increase in the lambda control factor is halted.

As the lambda probe 4 frequently has an asymmetrical reaction time, i.e. detects a change from a lean to a rich mixture or from a rich to a lean mixture with different reaction times, a first dwell time TDLY1 can be provided, during which after identification of a change from a lean to a rich mixture and vice-versa the lambda factor is maintained, before it is quickly reset by a P step. For the following lean half-period, i.e. after the P step of the lambda control factor, the lambda control factor is decreased continuously, i.e. step by step, so the fuel mixture is depleted. If the lambda probe now indicates that the fuel mixture is too lean, the step by step decrease in the lambda control factor is halted and after a second dwell time TDLY2 a P step is effected in the lambda control factor. The second dwell time TDLY2 can be different from the first dwell time TDLY1.

A second time segment T2 now shows the characteristics of the lambda control factor in a diagnosis operating mode, in which the performance of the catalyst is to be checked. In order to be able to carry out the diagnosis of catalyst performance with as little spread as possible between the diagnosis cycles, a constant oxygen concentration is required for all control cycles. In other words the change in oxygen concentration should be essentially the same in both the lean half-periods and the rich half-periods. It is irrelevant here whether it is a positive or a negative change in oxygen concentration.

In diagnosis operating mode regulation takes place in essentially the same way as in normal operating mode, as described above. As soon as a change has been detected from a too rich to a too lean fuel mixture during a lean half-period, the lambda control factor is first maintained as constant after a dwell time TDLY and then after the dwell time it is further depleted by a ΔP step. The period for which the maximum value should be maintained for the lambda control factor is based on the oxygen concentration achieved in the relevant half-period. In other words the maximum value of the lambda control factor is maintained until a defined oxygen concentration has been achieved in said control cycle.

To determine the oxygen concentration of the control cycle the characteristics over time of the oxygen input have to be determined for each half-period. The following applies:

$$m_{O_2} = 23\% \cdot \int_0^{t_M} \left(1 - \frac{1}{\lambda}\right) \cdot \dot{m}_L \, dt$$

whereby $m_{O_2}$ represents the oxygen concentration, $t_M$ the time of the half-period, λ the lambda value of the fuel mixture, (λ=1 for the stoichiometric mean) and $\dot{m}_L$ the mass air flow. As the λ is a function of the lambda control factor, the following results:

$$m_{O_2} = 23\% \cdot \int_o^{t_M} \left(1 - \frac{1}{\lambda_{t\arg} + \Delta\lambda_{t\arg}}\right) \cdot \dot{m}_L \, dt$$

whereby $\lambda_{t\ arg}$ represents the mean value of the λ regulator over a period of λ control fluctuation and $\Delta\lambda_{t\ arg}$ the characteristics of depletion. The factor 23% results from the proportion of oxygen in the air.

$\Delta\lambda_{t\ arg}$ is positive during the lean half-period and negative during the rich half-period. The formulae can be used in the same way for the oxygen evacuation process during the rich half-period.

In the case of binary lambda control the value λ is not known directly. λ can be calculated from the lambda control factor, which represents a multiplying factor of the basic injection quantity. The lambda control factor corresponds in converse proportion to the λ displacement. The respective mean value is a mean control intervention over a control cycle and corresponds to $\lambda_{t\ arg}$ and $\Delta\lambda_{t\ arg}$ is the difference between current value and mean value of the lambda control factor. The following results:

$$m_{O_2} = 23\% \cdot \int_o^{t_M} \left(1 - \frac{\text{FAC_LAM} - \text{FAC_LAM_MW}}{\text{FAC_LAM_MV}}\right) \cdot \dot{m}_L \, dt$$

where FAC_LAM is the instantaneous multiplying lambda control factor and FAC_LAM_MV its mean value over the entire lambda control period. This integration allows the oxygen concentration to be determined for every lean and rich half-period of lambda regulation. As the current mass air flow $\dot{m}_L$ is taken into account, the change in the operating point of the engine is also taken into account.

To avoid displacement of the lambda value, in diagnosis operating mode the dwell time and range of the step by step change in the lambda control factor are kept the same. To achieve the required predetermined oxygen concentration as quickly as possible however after the dwell time the lambda control factor can be increased in the lean half-period by a P step ΔP and decreased during the rich half-period by a P step ΔP, in order to achieve the increased oxygen concentration—positively or negatively—for the catalyst efficiency diagnosis more quickly.

The period during which the maximum or minimum value of the lambda control factor is output by the regulator 3 is a function of the required oxygen concentration, i.e. the lambda control factor is maintained until the required oxygen concentration according to the above formula is achieved.

When the required oxygen concentration is achieved the lambda control factor is reset by the sum of the lambda control factor changes effected during the step by step increases or decreases in the respective half-period and the additional P step ΔP. The sum results from the sum of all step by step increases or decreases of the lambda control factor and the additional increase or decrease to the maximum difference or minimum value of the lambda control factor over the entire lambda control cycle.

The maximum or minimum value of the lambda control factor results from the maximum diffusion speed of the oxygen into the active layer or washcoat of the catalyst or out. The maximum or minimum value of the lambda control factor is therefore determined by how quickly oxygen can be absorbed from the exhaust gas stream, which is guided through the catalyst, and emitted into the active layer or washcoat. The maximum or minimum control factor therefore results from a predetermined oxygen concentration value. If the lambda control factor is set as greater than the maximum value or smaller than the minimum value, this does not mean that more oxygen is absorbed or emitted. As a result the catalyst is no longer able to buffer the λ fluctuations produced by the control cycles in respect of the output of the catalyst, so that no fluctuations can be detected there, even though the oxygen storage capacity of the catalyst has not yet been exhausted.

The defined oxygen concentration, which is set to diagnose catalyst efficiency, corresponds to the oxygen storage capacity of an ageing catalyst, which still complies with the requirements relating to efficiency.

The efficiency diagnosis takes place using a λ monitor probe (not shown), which is also a lambda probe, whereby the monitor probe is placed in the exhaust gas stream behind the catalyst 5. The monitor probe then detects whether a constant lambda value has been achieved or whether the lambda value fluctuates according to the control cycle. If the lambda value measured by the monitor probe fluctuates, the catalyst being checked does not have adequate oxygen storage capacity and a defective or ageing catalyst is detected.

The degree of ageing of the lambda control probe and the resulting delay in detecting the exhaust gas change rich <-> lean are also taken into account in the oxygen concentration calculation and target value adjustment. If the reaction time of the lambda probe is extended due to ageing phenomena, the step by step increase or decrease in the lambda control factor is carried out for longer so that a higher oxygen concentration is achieved in the catalyst as well as a higher amplitude in the λ control factor and λ fluctuation before a change is detected between a too rich and a too lean fuel mixture. The amplitude of the lambda control factor is therefore limited to the maximum difference in respect of the lambda control factor mean value, which means that the additional step ΔP is not completed.

The idea behind the invention is to supply a method for binary lambda regulation based on oxygen concentration, whereby after the dwell time a further step of the lambda control factor in the original direction is provided, to achieve the increased oxygen concentration more quickly. However in order to prevent an excessive increase in the amplitude of the lambda control factor and lambda fluctuation due to ageing of the lambda control probe and its associated extension of probe reaction time, the additional P step is limited so when added to the I part integrated over a half-period it cannot exceed the maximum difference in respect of the mean value of the lambda control factor. Thus even with an ageing binary lambda control probe with a slower dynamic it is possible to prevent an increase occurring in the lambda amplitude.

The catalyst oxygen balance is achieved solely via the oxygen concentration integrals, which have to balance each other out in the rich and lean periods. This results in an increase in the accuracy of oxygen concentration adjustment, primarily in non-stationary processes or minor malfunctions. Lambda control based on oxygen concentration allows the times, during which the maximum or minimum lambda control factor is maintained or the amplitude increases to be adjusted adaptively based on the maximum or minimum lambda control factor.

Alternatively after detection of a change between a lean and rich fuel mixture, the lambda control factor is not adjusted to a maximum or minimum value but the lambda control factor is maintained until the predetermined oxygen concentration is achieved.

The invention claimed is:

1. A method for adjusting a defined oxygen concentration by means of binary lambda regulation in order to diagnose a catalyst whereby regulation of the catalyst results in control cycles, the method comprising the following steps:

catalyst diagnosis is carried out at a predetermined defined oxygen concentration for each control cycle, a fuel mixture can be adjusted to rich or lean according to a lambda control factor, a rich or lean exhaust gas is detected, in the case of a lean exhaust gas, the lambda control factor is increased incrementally, in the case of a rich exhaust gas the lambda control factor is decreased incrementally, after a change has been detected from a rich exhaust gas to a lean exhaust gas or from a lean exhaust gas to a rich exhaust gas, the lambda control value is changed by a P step, after a change has been detected from a rich exhaust gas to a lean exhaust gas the lambda control factor is set during a first loading time to a minimum control factor value, which represents a local minimum for the control factor value in the current control cycle, and after a change has been detected from a lean exhaust gas to a rich exhaust gas the lambda control factor is set during a second loading time to a maximum control factor value, which represents a local maximum for the control factor value in the current control cycle, whereby the first loading time is adjusted so that the oxygen concentration achieves an oxygen input defined by the predetermined oxygen concentration in each control cycle, and whereby the second loading time is adjusted so that the oxygen concentration achieves an oxygen output defined by the predetermined oxygen concentration in each control cycle.

2. The method according to claim 1, wherein the predetermined oxygen concentration is determined by the maximum oxygen storage capacity of an ageing catalyst.

3. The method according to claim 1, wherein the minimum and maximum control factor values are defined by the difference between the lambda control factor and a mean value of the lambda control factor for the current control cycle, whereby the difference is predetermined by the oxygen absorption capacity of the catalyst.

4. A regulator for adjusting a defined oxygen concentration by means of binary lambda regulation in order to diagnose a catalyst, comprising:

the regulator carries out catalyst diagnosis at a predetermined defined oxygen concentration for each control cycle, the regulator regulates the composition of a fuel mixture with control cycles, the regulator can be connected to a mixer to adjust the fuel mixture to rich or lean according to a lambda control factor, a lean exhaust gas or rich exhaust gas can be detected using a sensor, in the event of a lean exhaust gas for the fuel mixture, the regulator increases the lambda control factor incrementally and in the event of a rich exhaust gas for the fuel mixture, it decreases the lambda control factor incrementally, the regulator changes the lambda control factor by a P step, after a change has been detected from a rich exhaust gas to a lean exhaust gas or from a lean exhaust gas to a rich exhaust gas for the fuel mixture, the regulator sets the lambda control factor to a minimum control factor during a first loading time after a change has been detected from a rich exhaust gas to a lean exhaust gas for the fuel mixture and sets the lambda control factor to a maximum control factor during a second loading time after a change has been detected from a lean exhaust gas to a rich exhaust gas for the fuel mixture, and the first and second loading times are determined such that the oxygen concentration achieves the predetermined defined oxygen concentration in each control cycle.

5. The regulator according to claim 4, wherein the regulator can be operated in a diagnosis mode to carry out diagnoses and in a second operating mode, in which the regulator regulates the catalyst according to a normal operating mode.

* * * * *